United States Patent [19]

Birrell et al.

[11] 4,319,690

[45] Mar. 16, 1982

[54] CHILD-RESISTANT CLOSURE AND CONTAINER ASSEMBLY INCLUDING IMPROVED OUTER CAP

[75] Inventors: Stewart H. Birrell, Misissauga; Peter Hedgewick, Windsor, both of Canada

[73] Assignee: International Tools (1973) Limited, Windsor, Canada

[21] Appl. No.: 206,411

[22] Filed: Nov. 14, 1980

Related U.S. Application Data

[63] Continuation-in-part of Ser. No. 187,096, Sep. 24, 1980, abandoned, which is a continuation-in-part of Ser. No. 103,308, Dec. 13, 1979.

[51] Int. Cl.[3] ..... B65D 55/02

[52] U.S. Cl. ..... 215/220

[58] Field of Search ..... 215/220

[56] References Cited

U.S. PATENT DOCUMENTS 3,055,524 9/1962 Glasbrenner ..... 215/220

3,863,796 2/1975 Roy ..... 215/220

4,165,813 8/1979 Babiol ..... 215/220

*Primary Examiner*—George T. Hall

*Attorney, Agent, or Firm*—Reising, Ethington, Barnard, Perry & Brooks

[57] ABSTRACT

A safety closure and container assembly including a container and a closure comprising outer and inner caps which may be attached to the container by conventional capping machines. In first, second, third and fourth embodiments of the invention, the inner cap is formed with a circular dome-shaped top panel with a skirt portion projecting axially therefrom. The projecting skirt portion is threaded on its interior surface for engagement with a conventionally threaded container finish. A plurality of upwardly extending and spaced apart drive members are integrally molded with the periphery of the top panel. A plurality of ramped ratchet lugs also extend upwardly from the upper surface of the top panel. The outer cap has a circular end wall with an axially projecting second skirt portion.

22 Claims, 11 Drawing Figures

CHILD-RESISTANT CLOSURE AND CONTAINER ASSEMBLY INCLUDING IMPROVED OUTER CAP

This application is a continuation-in-part of application Ser. No. 187,096, now abandoned, filed Sept. 24, 1980 which, in turn, is a continuation-in-part of application Ser. No. 103,308, filed Dec. 13, 1979, the entire disclosures of which are incorporated herein by reference.

TECHNICAL FIELD

This invention relates generally to safety closure and container assemblies and is particularly concerned with safety closures which may be applied to containers having standard finishes with conventional capping machines.

BACKGROUND ART

In order to reduce the number of accidental poisonings resulting from young children having access to unsafe medicines, drugs, household chemicals and other products, there has been considerable activity in recent years toward the development of closures and containers in which a type of manipulation between the cap and container is required in order to gain access to the contents of the container that a young child is incapable of performing. For example, it has been found that young children are generally incapable of manipulating a cap mounted on a container bayonet type locking means—a type of locking means which requires that the cap be pushed relative to the container and then rotates relative to the container in order to separate the cap from the container. The cap must be pushed axially toward the container against the biasing force of a spring-like element in order to disengage the bayonet locking means. See, for example, Hedgewick U.S. Pat. No. Re. 27,156.

There are many caps of the type having an inner cap adapted to threadedly engage the neck portion of a container and an outer cap fixedly attached over the inner cap to prevent external access thereto. The outer cap is generally spring-biased away from the cap to provide relatively free rotation therebetween. Upon pushing the outer cap toward the inner cap, the two caps engage in some manner so as to produce rotation of the inner cap with the outer cap and allow unthreading thereof. Examples of such caps are disclosed in U.S. Pat. Nos. 2,964,207, 3,374,912, 3,394,829, 3,396,864, 3,764,033, 3,853,236, 3,857,505 and 3,944,102. A problem with many of such closures is that they cannot be applied with conventional capping machinery.

Another problem is that it is difficult to produce such closures by mass production molding and assembly techniques because of their structural design. Other problems result when the two parts forming the closure include unnecessary material. If the two parts do not fit correctly with respect to each other, cocking occurs and the closure will often fail as the mating and/or engaging portions of the inner and outer caps become excessively worn.

Other patents to which this invention generally relates are U.S. Pat. Nos. 3,432,065, 3,753,510, 4,002,259 and 4,042,028.

DISCLOSURE OF THE INVENTION

The present invention is concerned with a child-resistant closure and container assembly with standard container finishes formed on the exterior of the container. The closure includes an outer cap and an inner cap, the inner cap having a dome-shaped top panel and a skirt portion projecting axially therefrom. Ratchet lug means are disposed on the top surface of the dome-shaped top panel in a circular arrangement for engagement by a plurality of inclined detent members arranged in a similar fashion on the inner surface of the outer cap. The dome-shaped top panel provides a biasing force to maintain the inner and outer caps normally in a second axial position. In this position the detent members engage the ratchet lug means to drive the inner and outer caps as a unit in the closure tightening direction but will slip over the ratchet lug means freely in the untightening direction to prevent removal of the inner cap from the container finish portion. Downward pressure on the outer cap will overcome the bias of the dome-shaped top panel to place the inner and outer caps in a first axial position wherein the inner and outer caps are coupled thereby allowing rotation of the inner and outer caps in unison to allow removal of the closure.

A preferred embodiment of a safety closure assembly includes an inner cap having a dome-shaped top panel with a skirt portion projecting axially therefrom. The depending skirt portion has cap locking means formed on the inner surface thereof which is adapted to engage with and disengage from complementary container locking means on a container. The outer cap has an end wall with a skirt portion projecting axially from the periphery thereof. The end wall has an annular portion having a smaller thickness than the remainder of the end wall. The second skirt portion loosely encompasses the first skirt portion to allow relative rotary movement between the inner and outer caps. Clutch means operatively associated with the inner surface of the outer cap and the outer surface of the inner cap couple the inner and outer caps in one position of axial displacement of the inner and outer caps and uncouple the inner and outer caps in a second axial position of the inner and outer caps. Ratchet lug means are circularly disposed on one of the inner and outer caps and interposed the caps. A plurality of spaced inclined detent members are circularly disposed on one of the inner and outer caps and interposed the caps. The dome-shaped top panel provides a biasing force to maintain the inner and outer caps in the second axial position. The detent members drivingly engage the ratchet lug means in the second axial position to drive the inner and outer caps as a unit in the tightening direction of the closure and slip over the ratchet lug means in the untightening direction to prevent unscrewing of the inner cap. Downward axial pressure on the outer cap overcomes the bias of the dome-shaped panel by causing a portion of the outer cap to deform the dome-shaped panel to place the inner and outer caps in a first axial position. Retaining means loosely retain the inner cap within the outer cap.

Both the inner and outer caps are preferably molded out of plastic by molding apparatus.

Also preferably, the inner cap has a plurality of upwardly extending stop ribs to prevent the outer cap from collapsing the dome-shaped top panel during shipment of the assemblies.

Other advantages and features of the invention will become apparent from the following description taken in connection with the accompanying drawings.

BEST MODE FOR CARRYING OUT THE INVENTION

Figure 1:
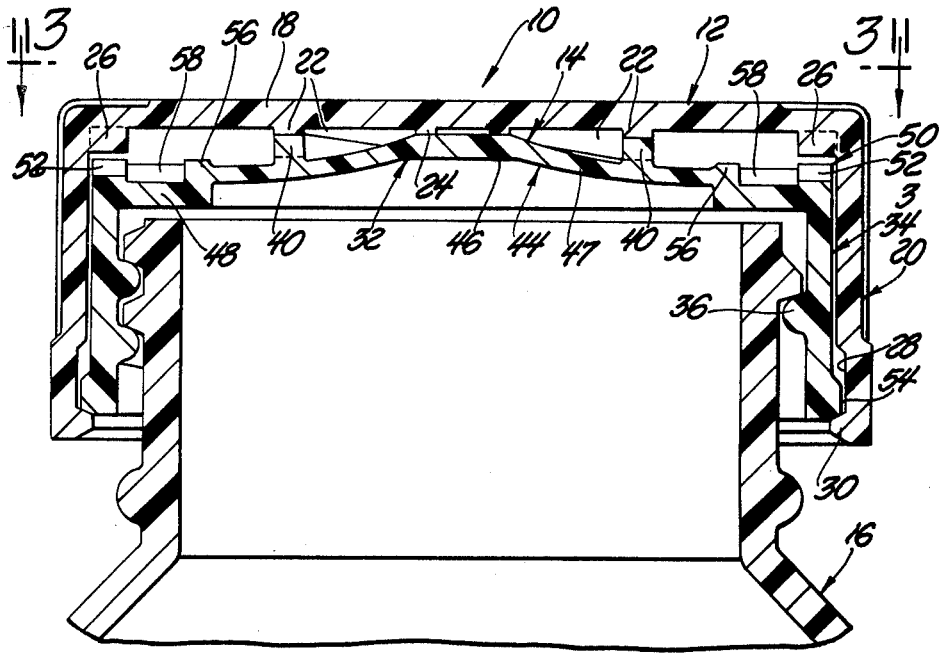
FIG. 1 is a sectional view of the safety closure and container assembly embodying the invention.
Figure 2:
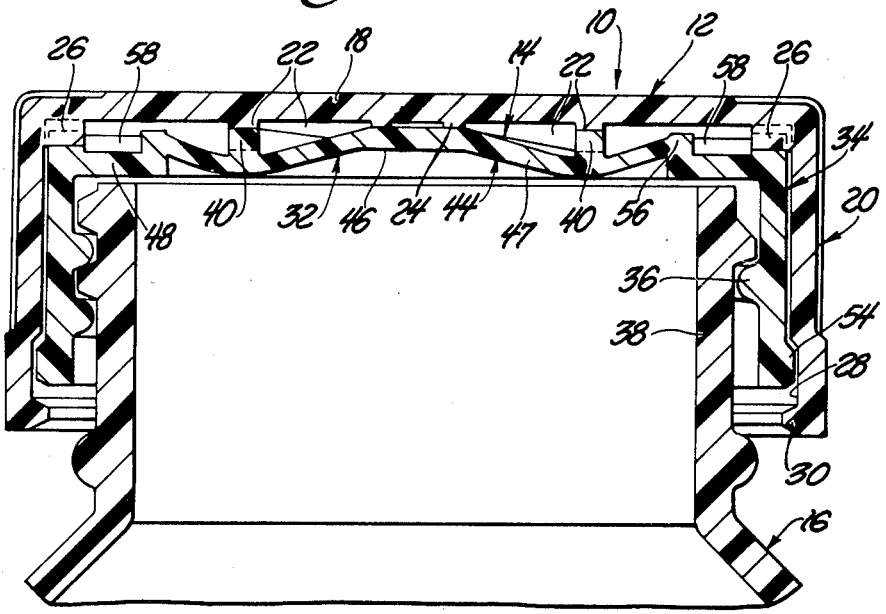
FIG. 2 is a sectional view of the safety closure assembly held under axial downward force on the container.
Figure 3:
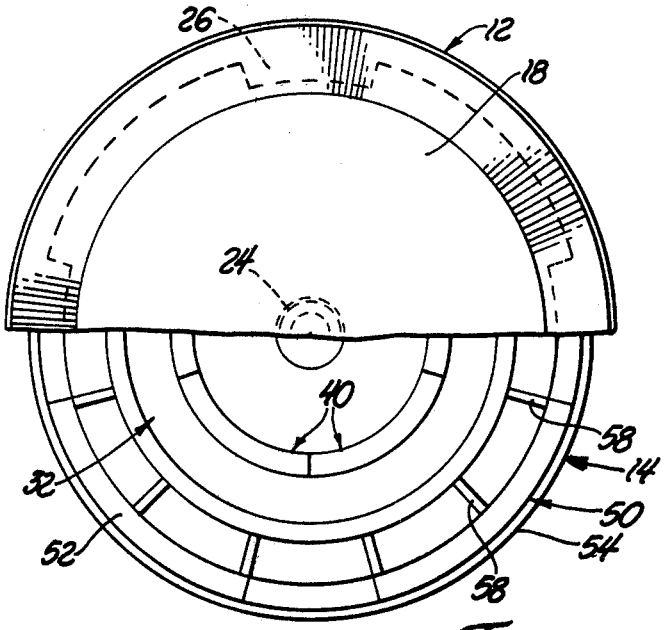
FIG. 3 is a top fragmentary view taken on lines 3—3 of FIG. 1.

In the drawings reference numeral 10 collectively designates a first embodiment of a safety closure and container assembly of the present invention as shown in FIGS. 1 and 2. The assembly 10 comprises a closure including an outer cap 12, and an inner cap 14 and a container 16. The inner cap 14 is loosely encompassed within the outer cap 12 to allow relative rotary movement between the outer and inner caps 12 and 14, respectively. The inner and outer caps 12 and 14 are coupled together so that they move together as a unit in the tightening direction of the closure and the outer cap 12 rotates freely of the inner cap 14 when the outer cap 12 is rotated in the untightening direction to prevent unscrewing of the inner cap 14 from the container 16. Downwardly axial pressure on the outer cap 12 couples the inner and outer caps 14 and 12 together so that when the outer cap 12 is rotated in the untightening direction the inner cap 14 is unscrewed from the container 16.

Figure 4:
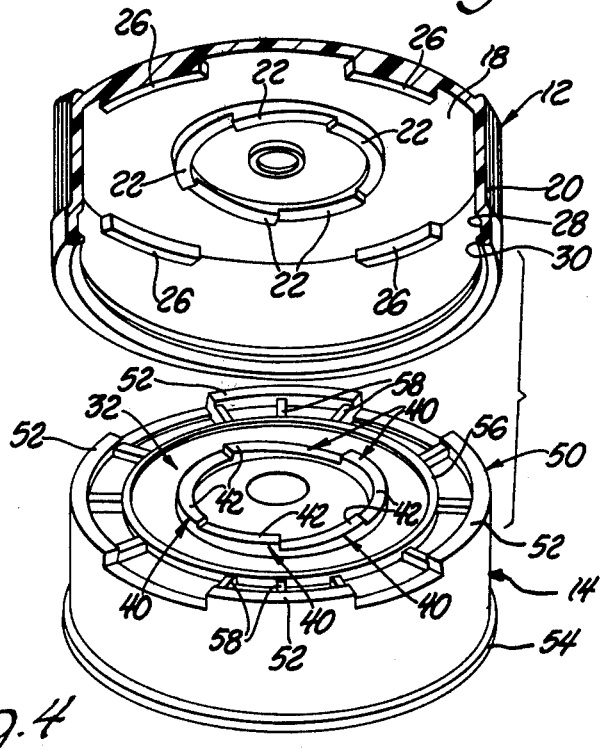
FIG. 4 is an exploded, fragmentary perspective view of the safety closure assembly.

With reference to FIGS. 1 and 2 the outer cap 12 is formed with a circular end wall 18 integrally molded with a depending skirt portion 20. Molded into the underside of the end wall 18 and extending into the interior of the outer cap 12 are a plurality of detent members or inclined ramped ratchet lugs 22, as best shown in FIG. 4. The ratchet lugs 22 are integrally formed and circularly disposed about an annular stop member 24 which is also molded into the underside of the end wall 18. Both the ratchet lugs 22 and the stop member 24 are concentrically arranged about the center of the circular end wall 18.

The embodiment shown in FIG. 4 shows five ratchet lugs 22, but as few as two ratchet lugs will operate satisfactorily and more than five ratchet lugs may be employed if desired. The angle of inclination of the ratchet lugs may be varied so long as the ratcheting function to be described hereinbelow may be properly performed.

In addition to the ratchet lugs 22, a plurality of drive lugs 26 are also molded into the underside of the end wall 18 and depend downwardly. The drive lugs 26 are preferably located adjacent to the extreme outer portion of the inside diameter of the outer cap 12 adjacent to the depending skirt portion 20. The illustration of four drive lugs 26 is simply by way of illustration and a single drive lug would function properly but multiple drive lugs are preferred to allow a number of different removal engagement positions as will be described hereinbelow.

A recess 28 and a retention means in the form of an annular, radially inwardly extending lip 30 are molded into the interior wall of the skirt portion 20. The lip 30 is continuous about the entire circumference of the skirt portion 20.

The outer cap 12 may be manufactured of any material sufficiently strong to stand up under wear. Materials which have proven successful for this purpose are modified styrene and polypropylene.

The inner cap 14 is also formed as an integral unit and has a dome-shaped top panel 32 and a depending skirt portion 34 attached thereto at its outer periphery. The interior of the skirt portion 34 may be provided with threads 36 for engagement with a threaded exterior finish portion 38 of the conventional container 16. Projecting vertically out from and integrally attached to the top panel 32 are a plurality of inclined ramped ratchet lugs 40. In the embodiment shown in FIG. 4, there are five ratchet lugs, each of which has an inclined ramped upper surface 42. The beginnings of the upper surfaces 42 are in a plane slightly above the plane of the top panel 32. The ends of the upper surfaces 42 terminate at an elevation such that the ratchet lugs 22 of the outer cap 12 engage the lugs 40. This occurrence takes place when the inner cap 14 is assembled within the outer cap 12 and its precise function will be described in detail hereinbelow.

The dome-shaped top panel 32 includes a dome portion 44 having a cylindrical base portion 46 which is concentric with the stop member 24. The base portion 42 engages and is biased against the outer surface of the stop member 24 by an annular web-like portion 47 of the dome portion 44. The web-like portion 47 flares outwardly in a bell-shaped configuration from the outer periphery of the base portion 46 to the inner periphery of the flange 48. The stop member 24 cooperates with the base portion 46 to maintain the inner cap 15 centered with respect to the outer cap 12.

The top panel 32 also includes a flange 48 integrally formed at the outer periphery of the dome portion 44 and projecting radially outwardly therefrom. The flange 48 is also integrally formed with the skirt portion 34 which downwardly depends therefrom.

The upper peripheral portion of the inner cap 14 includes an outer ring wall 50 which rises above the plane of the flange 48. Spaced at intervals around the outer ring wall 50 are upwardly extending drive members 52. In the assembled closure assembly the drive lugs 26 on the interior of the outer cap 12 are dimensioned such that they may mesh into the openings between the drive members 52. This imparts driving force to the inner cap 14 so that it may be driven with the outer cap 12.

A retention bead 54 is molded into the exterior surface of the depending skirt portion 34. The retention bead 54 extends about the entire circumference of the skirt portion 34 and is of a diameter greater than that of the retention lip 30 formed on the skirt portion 20 of the outer cap 12.

Also formed at the upper peripheral portion of the inner cap 14 is an inner ring wall 56 which also projects above the plane of the flange 48. The inner ring wall 56 is spaced radially inwardly from the outer ring wall 50. A plurality of radially extending reinforcing ribs 58 are formed on the upper surface of the flange 48 and interconnects the inner ring wall 56 with the outer ring wall 50 at the drive members 52.

The inner cap 14 is an independent closure in itself for a container. The inner cap 14 may be made of any suitable material and need not necessarily be the same material as that of the outer cap 12. It has been found that a thermoplastic material such as polypropylene or polythene is particularly well-adapted for the manufacture of the inner cap 14.

The closure is formed by assembling the outer cap 12 and the inner cap 14. To assemble the completed closure assembly, the retention lip 30 is forced over the retention bed 54, the process causing the skirt portion 20 of the outer cap 12 to spring slightly outwardly. Once the retention lip 30 has passed over the retention bead 54, the skirt portion 20 springs back inwardly trapping the inner cap 14 within the outer cap 12. As shown in FIG. 1, the fit between the outer cap 12 and the inner cap 14 is not tight in a radial direction since there is an appreciable gap between the interior of the skirt portion 20 and the exterior of the skirt portion 34. However, the fit between the outer cap 12 and the inner cap 14 is tight in an axial direction since there is no gap between the top panel 32 and the stop member 24 nor between the retention lip 30 and the retention bead 54.

As shown in FIG. 1, engagement of the base portion 46 with the stop member 24 and engagement of the retention bead 54 and the retention lip 30, provides a known spring force to keep the inner cap 14 separated from the outer cap 12 about the outer periphery of the inner cap 14.

A sealing disc (not shown) may be provided between the upper surface of the finish portion 38 and the lower portion of the flange 48. The sealing disc may comprise any material suitable for sealing the contents of the container. The sealing disc may be mounted on the lower surface of the flange 48 by a suitable adhesive.

The completed closure assembly may be screwed onto the finished portion 38 of the container 16 since rotation of the outer cap 12 will cause the ratchet lugs 22 of the outer cap 12 to drivingly engage the ratchet lugs 40 formed on the upper surface of the dome portion 44 and consequently turn the outer cap 12 and the inner cap 14 as a unit in the tightening direction. Conversely, it may be seen that if the outer cap 12 were rotated in the opposite direction or in the normally, unscrewing direction, the ratchet lugs 22 of the outer cap 12 would slip over the ratchet lugs 40 of the inner cap 14. The outer cap 12 thus can rotate freely with respect to the inner cap 14 in the loosening direction. It is this feature which makes the closure assembly 10 child-resistant since it is impossible to unscrew the entire assembly 10 without additional motion. Furthermore, the gap between the skirt portion 20 of the outer cap 12 and the skirt portion 34 of the inner cap 14 makes it unlikely that a child could compress the outer cap 12 by squeezing it against the inner cap 14 sufficiently to be able to unscrew the inner cap 14 from the finish portion 38 of the container 16.

To remove the closure assembly from the finish portion 38 of the container 16, the outer cap 12 must be compressed downwardly over the inner cap 14 as shown in FIG. 2. The configuration of FIG. 1 may be considered one position of axial displacement of the outer cap 12 and the inner cap 14, while the configuration of FIG. 2 may be considered a second position of axial displacement of the outer cap 12 and inner cap 14. The dome portion 44 serves to normally keep the outer cap 12 and the inner cap 14 in the relationship shown in FIG. 1, in which configuration removal of the closure assembly from the container 16 is not possible. However, in utilizing the spring function of the dome portion 44, the outer cap 12 may be pressed downwardly over the inner cap 14. The downward displacement of the outer cap 12 brings the drive lugs 26 into the space between the guide members 52. Although the alignment of the drive lugs 26 in the spaces between the drive members 52 may not be perfect at the time the outer cap 12 is pressed downwardly, slight rotation of the outer cap 12 in the loosening direction will bring the drive lugs 26 into proper drive engagement. With the drive lugs 26 properly engaged, the outer cap 12 may be rotated and the inner cap 14 will rotate with it as a unit throughout this driving engagement.

Once the closure assembly is removed from the container 16 and the downward pressure on the outer cap 12 is released, the closure assembly will spring back to the configuration shown in FIG. 1 under the springing influence of the dome portion 44. The closure assembly is again in a configuration suitable for reapplication to the container 16.

The closure assembly assembled from the inner cap 14 and the outer cap 12 may be applied by conventional capping machinery since there is no need for any manipulation of the closure assembly during the tightening procedure.

Figure 5:
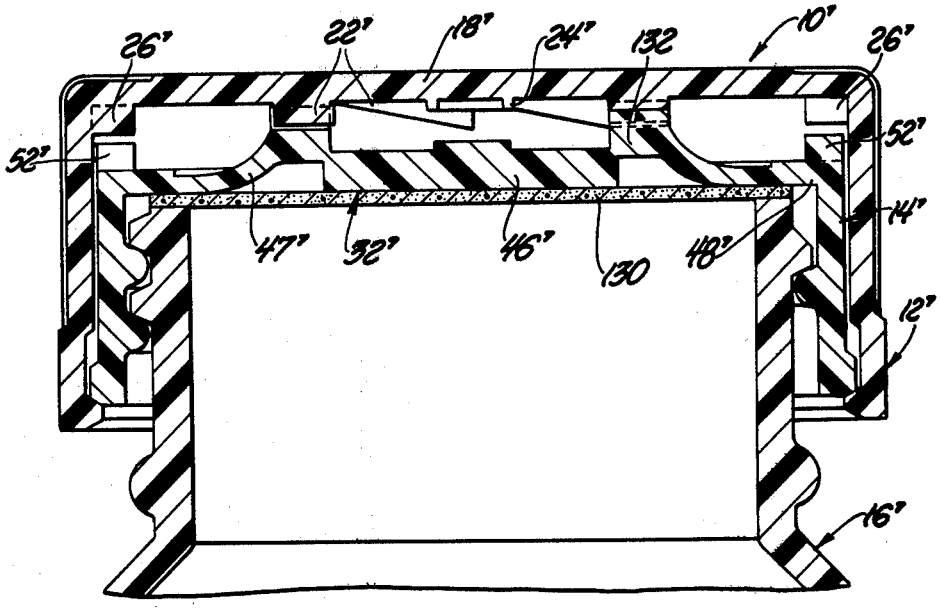
FIG. 5 is a sectional view of a second embodiment of the invention.
Figure 6:
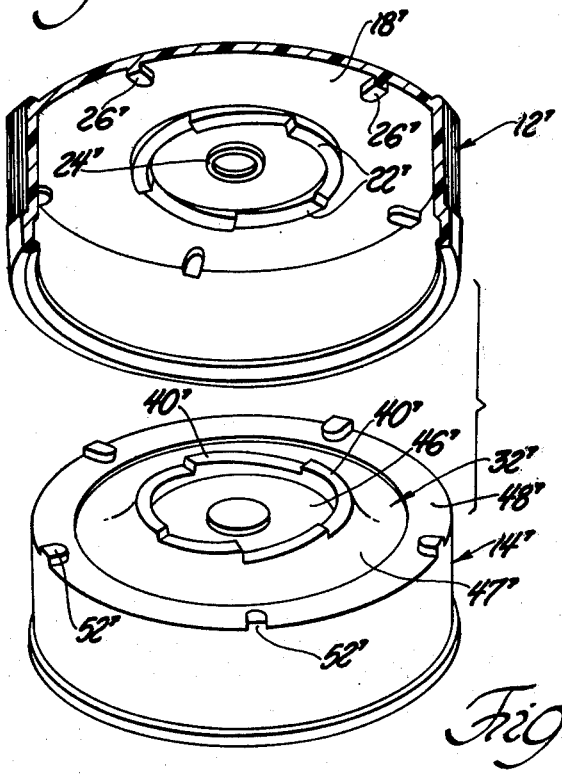
FIG. 6 is an exploded, fragmentary perspective view of the second embodiment.

With reference to FIG. 5 there is shown a second embodiment of a safety closure and container assembly of the present invention which is collectively indicated at 10'. The assembly 10' includes a container 16'. The closure assembly alone is shown in FIG. 6 and includes an outer cap 12' and an inner cap 14' as in the first embodiment. Those elements of the second embodiment which have the same or similar structure and/or function as the elements of the first embodiment, have the same reference numeral, but are primed to distinguish those elements from the elements of the first embodiment. Only those elements which are substantially different in structure and/or function will be described hereinbelow.

Referring initially to the outer cap 12' as shown in FIG. 6, a plurality of drive nibs 26' comprising five in number, are molded into the underside of an end wall 18' of the outer cap 12' and depend downwardly. A single drive nib will function as described hereinbelow, but multiple drive nibs 26' are preferred to allow a number of different removal engagement positions.

Ratchet lugs 22' of the outer cap 12' are circularly disposed about an annular stop member 24'. Each of the ratchet lugs 22' is formed separate from the other ratchet lugs 22'. The outer cap 12' can be manufactured of any material sufficiently strong to stand up under operation. A material which has been proved to be successful for this purpose is polypropylene.

The inner cap 14' of the closure assembly of the second embodiment includes five inclined ramped ratchet lugs 40' circularly disposed on the outer peripheral portion 132 of a relatively rigid central base portion 46' of the dome-shaped top panel 32' of the inner cap 14'. The base portion 46' projects inwardly from the bottom surface of the top panel 32' and has a bottom surface where a sealing disc 130 may be adhesively secured.

The sealing disc 130 may comprise any suitable material for sealing the contents of the container 16' therein.

A web-like portion 47' of the top panel 32' flares outwardly from the base portion 46, in a bell-shaped configuration in the same fashion as the web-like portion 47 of the first embodiment.

A flange 48' of the top panel 32' extends radially outwardly from the periphery of the web-like portion 47' and includes a plurality of upwardly extending nibs 52' comprising five in number. In the assembled closure assembly the drive nibs 26' on the interior of the outer cap 12' engage the nibs 52' when the combined axial and unscrewing driving forces are imparted to the outer cap 12' to unscrew the inner cap 14' from the container 16'.

When the base portion 46 is pushed in a downward direction at the ratchet lugs 40' on the peripheral portion 132 by the ratchet lugs 22' of the outer cap 12', the web-like portion 47' flexes or deforms to allow drive nibs 26' to engage the nibs 52'. The base portion 32' including the peripheral portion 132 do not deform but rather cause the sealing disc 130 to flex inwardly into the container 16'.

Figure 7:
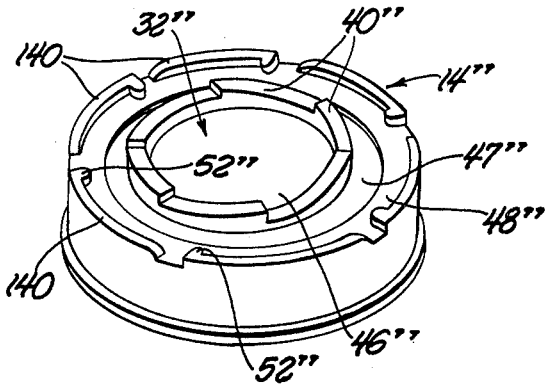
FIG. 7 is a perspective view of the inner cap of the third embodiment of the invention.
Figure 8:
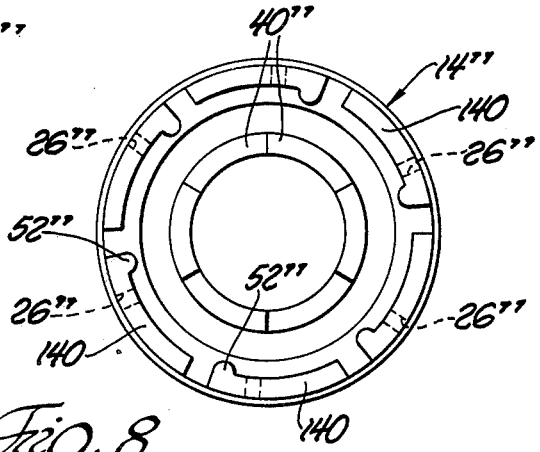
FIG. 8 is a top view of the inner cap of FIG. 7 with the drive lugs of the outer cap shown in phantom.
Figure 9:
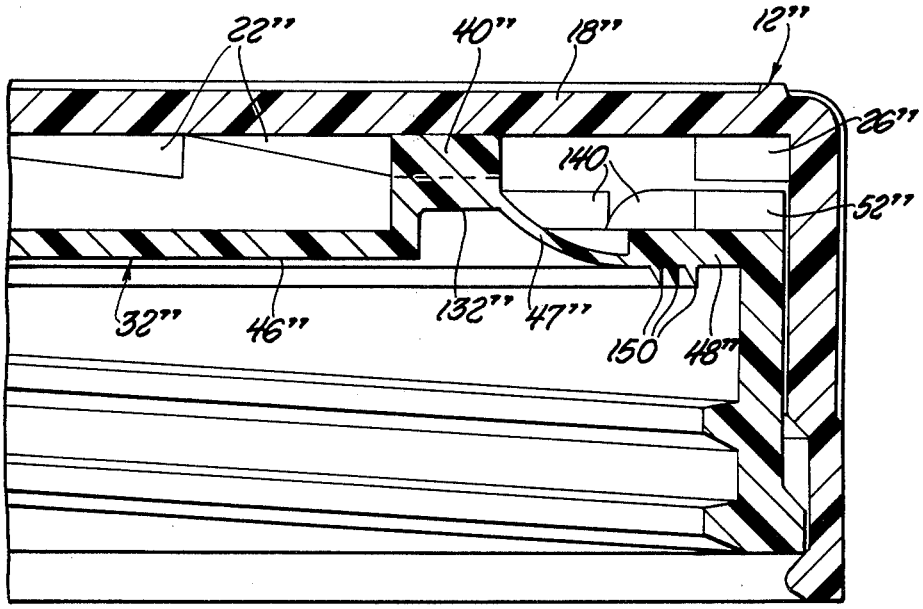
FIG. 9 is a sectional, fragmentary view of the assembled inner and outer caps of the third embodiment.

With reference to FIGS. 7, 8 and 9 there is shown a third embodiment of an outer cap 12'' and an inner cap 14'' as in the first and second embodiments. Those elements of the third embodiment which have the same or similar structure and/or function as the elements of the first embodiment have the same reference numeral, but are double-primed to distinguish those elements from the elements of the first embodiment. Only those elements which are substantially different in structure and/or function will be described hereinbelow.

Referring initially to the outer cap 12'', a plurality of drive nibs 26'' preferably comprising six in number are molded into the underside of an end wall 18'' of the outer cap 12'' and depend downwardly. The outer cap 12'' also includes ratchet lugs 22'' which are circularly disposed about an annular stop member 24''. Each of the ratchet lugs 22' is formed separate from the other ratchet lugs 22''. The outer cap 12'' can be manufactured of any material sufficiently strong to stand up under operation. One such material is polypropylene.

The inner cap 14'' of the closure assembly of the third embodiment preferably includes six inclined ramped ratchet lugs 40'' circularly disposed on the outer peripheral portion 132'' of a relatively rigid base portion 46'' of a dome-shaped top panel 32''. The base portion 46'' projects inwardly from the bottom surface of the top panel 32''.

A web-like portion 47'' of the top panel 32'' flares outwardly from the base portion 46'' in a bell-shaped configuration in the same fashion as the web-like portion 47 of the first embodiment.

A flange 48'' of the top pane 32'' extends radially outwardly from the periphery of the web-like portion 47'' and includes a plurality of upwardly extending nibs 52'' comprising six in number. Integrally formed with the nibs 52'' are an equal number of upwardly extending stop ribs 140 which support the outer cap 12'' at its drive lugs or nibs 26'' when the inner cap 14'' is positioned within the outer cap 12'' and downward pressure is exerted at the top surface of the outer cap 12'' such as during shipping. The stop ribs 140 thereby prevent the ratchet lugs 22'' of the outer cap 12'' from overstressing and permanently deforming the dome-shaped top panel 32'' of the inner cap 14''. FIG. 8 shows the relative position of the drive nibs 26'' when the ratchet lugs 40'' and 22'' are engaged for screwing the inner cap 14'' on a container (not shown).

Rotation of the outer cap 12'' with respect to the inner cap 14'' after shipping allows the drive nibs 26'' on the interior of the outer cap 12'' to engage the nibs 52'' to permit combined axial and unscrewing driving forces imparted to the outer cap 12'' to unscrew the inner cap 14'' from its container.

When the base portion 46'' is pushed in a downward direction at the ratchet lugs 40'' on the peripheral portion 32'' by the ratchet lugs 22'' of the outer cap 12'', the web-like portion 47'' flexes or deforms to allow the drive nibs 26'' to engage the nibs 52''. The base portion 32'' including the peripheral portion 132'' flex inwardly toward the container.

A sealing disc is not needed since the lower surface of the flange 48'' includes a plurality of beads 150 which may be half-round, V-shaped or of any other desired configuration. The beads 150 may be accommodated with an annular, complementary recess formed on the top surface of the container. In this way the bottom surface of the flange 48'' and the top surface of the container come into interfacing sealing relationship.

Figure 10:
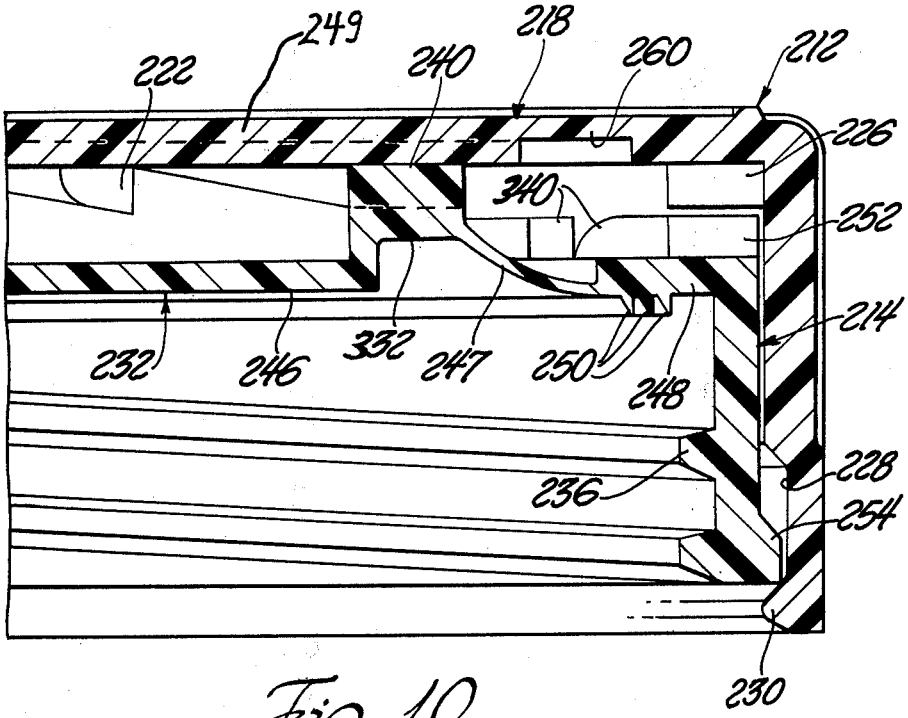
FIG. 10 is a sectional, fragmentary view of the assembled inner and outer caps of a fourth embodiment.
Figure 11:
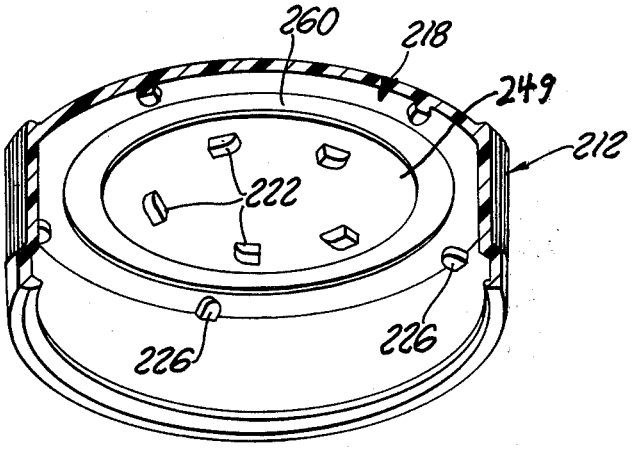
FIG. 11 is a perspective view of the outer cap of the fourth embodiment of the invention.

With reference to FIGS. 10 and 11 there is shown a fourth and preferred embodiment of an outer cap 212 and an inner cap 214 which is substantially the same as the inner cap 14''.

Referring initially to the outer cap 212 a plurality of drive nibs 226 comprising five in number are molded into the underside of an end wall 218 of the outer cap 212 and depend downwardly. The outer cap 212 also includes spaced, sloping, ratchet projections 222 which are integrally formed on the interior of the end wall 218. The ratchet projections 222 preferably comprise five in number and are circularly disposed radially inwardly from an annular portion 260 of the end wall 218. The annular portion 260 has a smaller thickness than the remainder of the end wall 218 to facilitate slippage of the outer cap 212 over an inner cap 214 (substantially the same as inner cap 14'') by allowing the part 249 of the end wall 218 circumscribed by the annular portion 260 to deform or deflect, In this way, the friction caused by movement of the ratchet projections 222 over the driven members formed on the outer surface of the inner cap 214, is minimized.

Each of the ratchet projections 222 is formed separate and spaced from the other ratchet projections 222. The relatively small amount of surface area of the ratchet projections 222 which engages the driven portions of the inner cap 214 minimizes the frictional effects between the projections 222 and the driven portions. In this way, slippage of the outer cap 212 over the inner cap 214 is facilitated to prevent removal of the closure unless the inner and outer caps 214 and 212, respectively, are first aligned and then the outer cap 212 is pressed down to overcome the bias of the dome-shaped top panel 232 of the inner cap 214.

The outer cap 212 can be manufactured of any material sufficiently strong to stand up under operation. One such material is polypropylene.

The inner cap 214 of the closure assembly of the fourth embodiment preferably includes five inclined, ramped ratchet lugs 240, circularly disposed on the outer peripheral portion 232 of a relatively rigid base portion 246 of the dome-shaped top panel 232.

A web-like portion 247 of the top panel 232 flares outwardly from the base portion 246 in a bell-shaped configuration in the same fashion as the web-like portion 47 and 47″ of the first and third embodiments, respectively.

A flange 248 of the top panel 232 extends radially outwardly from the periphery of the web-like portion 247 and includes a plurality of upwardly extending nibs 252 comprising five in number. Integrally formed with the nibs 252 are an equal number of upwardly extending stop ribs 340 which support the outer cap 212 at its drive lugs or nibs 226 when the inner cap 214 is positioned within the outer cap 212 and downward pressure is exerted at the top surface of the outer cap 212 such as during shipping. The stop ribs 340 thereby prevent the projections 222 of the outer cap 212 from overstressing and permanently deforming the top panel 232 of the inner cap 214.

The combined effect of relatively small, spaced, ratchet projections 222 and the annular portion 260 of reduced thickness is to minimize friction between the downward projections 222 and the ratchet lugs 240 and to prevent inadvertent removal of the closure from the container. In other words, the reduced amount of surface area of the ratchet projections 222 and the ability of the part 249 of the end wall 218 circumscribed by the annular portion 260 to deform, reduces friction between the projections 222 and the ratchet lugs 240 to allow the part 248 to move upwardly, thereby allowing additional slippage between the ratchet projections 222 and the ratchet lugs 240.

While specific forms of the invention have been illustrated and described, it should be understood that the invention is not limited to the exact constructions shown, but various alterations and modifications in the constructions and arrangements of parts will be possible without departing from the scope and spirit of the invention.

What is claimed is:

1. A safety closure assembly comprising: an inner cap having a dome-shaped top panel with a skirt portion projecting axially therefrom, said depending skirt portion having cap locking means formed on the inner surface thereof and adapted to be engaged with and disengaged from complementary container locking means on a container; an outer cap having an end wall with a second skirt portion projecting axially from the periphery thereof, said second skirt portion loosely encompassing the first skirt portion to allow relative rotary movement between the inner and outer caps; clutch means operatively associated with the inner surface of the outer cap and the outer surface of the inner cap and coupling the inner and outer caps in one position of axial displacement of said inner and outer caps and uncoupling the inner and outer caps in a second axial position of said inner and outer caps; ratchet lug means circularly disposed on one of said inner and outer caps and interposed said caps; a plurality of inclined detent members circularly disposed on one of said inner and outer caps and interposed said caps; said dome-shaped top panel providing a biasing force to maintain the inner and outer caps in said second axial position; said detent members drivingly engaging said ratchet lug means in said second axial position to drive the inner and outer caps as a unit in the tightening direction of the closure and slipping over said ratchet lug means in the untightening direction to prevent unscrewing of said inner cap; downward axial pressure on said outer cap overcoming the bias of said dome-shaped top panel by causing a portion of said outer cap to deform the dome-shaped panel to place the inner and outer caps in the first axial position; and retaining means for loosely retaining said inner cap within said outer cap in a radial direction.

2. The assembly as defined in claim 1 wherein said dome-shaped panel includes a central base portion and a web-like annular portion extending radially outwardly from the periphery of the base portion, and wherein said ratchet lug means is integrally molded on the outer periphery of said base portion, said annular portion providing said bias of said dome-shaped panel.

3. The assembly as claimed in claim 1 wherein said dome-shaped panel includes a base portion and a web-like annular portion extending radially outwardly from the periphery of said base portion and wherein said ratchet lug means is integrally molded on said annular portion, said annular portion providing said bias of said dome-shaped panel.

4. The assembly as defined in claim 2 or claim 3 wherein said ratchet lug means comprise at least two inclined ramped ratchet lugs integrally molded on the upper surface of the top panel and wherein said detent members are formed on the inner surface of the outer cap and deform the dome-shaped panel at the ratchet lugs.

5. The assembly as claimed in claim 4 wherein said detent members comprise at least two inclined ramped ratchet lugs integrally molded on the interior of said end wall.

6. The assembly as claimed in claim 2 or claim 3 wherein said clutch means includes at least two upwardly extending, spaced apart drive members integrally molded with the periphery of said dome-shaped top panel.

7. The assembly as claimed in claim 6 wherein said clutch means further includes at least one downwardly directed drive lug integrally formed on the interior of the end wall, said drive lug being positioned in the space between the drive members in the first position of axial displacement and being disengaged therefrom in the second position of axial displacement.

8. The assembly as claimed in claim 2 or claim 3 wherein said cap locking means comprises threads.

9. An inner cap member adapted to be loosely retained within the outer cap member of a safety closure to allow relative rotary movement therebetween, the inner cap member having a dome-shaped top panel with a skirt portion projecting axially therefrom; said depending skirt portion having cap locking means formed on the inner surface thereof and adapted to be engaged with and disengaged from complementary container locking means on a container; coupling means disposed on the outer surface of the inner cap member adapted for coupling the inner and outer cap members in one position of axial displacement of the inner and outer cap members and uncoupling the inner and outer cap members in a second axial position of the inner and outer cap members; said dome-shaped top panel being adapted to provide a biasing force to maintain the inner and outer cap members in said second axial position; ratchet lug means circularly disposed on the outer surface of the inner cap member and adapted to be driven by a driving portion of the outer cap member in the second axial position to drive the inner and outer cap members as a unit in the tightening direction of the closure and allowing the driving portion of the outer cap member to slip thereover in the untightening direction to prevent unlocking of the inner cap member; wherein the dome-shaped top panel is adapted to be deformed in response to downward axial pressure at its outer surface to place the outer and inner cap members in the first axial position.

10. The inner cap member as defined in claim 9 wherein said dome-shaped panel includes a central base portion and a web-like annular portion extending radially outwardly from the periphery of the base portion, and wherein said ratchet lug means is integrally molded on the outer periphery of said base portion, said annular portion providing said bias of said dome-shaped panel.

11. The inner cap member as defined in claim 9 wherein said dome-shaped panel includes a central base portion and a web-like annular portion extending radially outwardly from the periphery of the base portion, and wherein said ratchet lug means is integrally molded on said annular portion, said annular portion providing said bias of said dome-shaped panel.

12. The inner cap member as claimed in claim 10 or claim 11 wherein said ratchet lug means comprises at least two inclined ramped ratchet lugs integrally molded on the outer surface of the dome-shaped panel, spaced radially inwardly from the perimeter of the outer surface of the dome-shaped top panel.

13. The inner cap member as claimed in claim 10 or claim 11 wherein said coupling means includes at least two axially extending, spaced apart drive members integrally molded with the periphery of said dome-shaped top panel and adapted to receive a portion of the outer cap member in the space between the drive members in the first position of axial displacement.

14. The inner cap member as claimed in claim 13 wherein said dome-shaped panel includes a flange projecting radially outwardly from said annular portion and connected to said drive members.

15. The inner cap member as claimed in claim 12 including a plurality of radially outwardly projecting support ribs integrally formed on the outer surface of said dome-shaped panel at the outer periphery thereof.

16. The inner cap member as claimed in claim 10 and claim 11 wherein said cap locking means comprises threads.

17. A safety closure and container assembly comprising: a container having a mouth portion with an annular rim and container locking means formed on the outer surface of said mouth portion; an inner cap having a top dome-shaped panel with a skirt portion projecting axially therefrom, said depending skirt portion having cap locking means formed on the inner surface thereof; an outer cap having an end wall with a second skirt portion projecting axially from the periphery thereof, said second skirt portion loosely encompassing the first skirt portion to allow relative rotary movement between the inner and outer caps; clutch means operatively associated with the inner surface of the outer cap and the outer surface of the inner cap and coupling the inner and outer caps in one position of axial displacement of said inner and outer caps and uncoupling the inner and outer caps in a second axial position of said inner and outer caps; ratchet lug means circularly disposed on one of said inner and outer caps and interposed said caps; a plurality of inclined detent members circularly disposed on one of said inner and outer caps and interposed said caps; said dome-shaped panel providing a biasing force to maintain the inner and outer caps in said second axial position; said detent member drivingly engaging said ratchet lug means in said second axial position to drive the inner and outer caps as a unit in the tightening direction of the closure and slipping over said ratchet lug means in the untightening direction to prevent unscrewing of said inner cap; downward axial pressure on said outer cap overcoming the bias of said dome-shaped panel by causing a portion of said outer cap to deform the dome-shaped panel to place the inner and outer caps in the first axial position, said cap locking means being disengageable from said container by combined axial and rotary motion of said outer cap relative to the container; and retaining means for loosely retaining said inner cap within said outer cap in a radial direction.

18. The invention as claimed in claim 1 or claim 9 or claim 17 including stop means for selectively preventing said deformation of said dome-shaped top panel.

19. A safety closure assembly comprising: an inner cap having a dome-shaped top panel with a skirt portion projecting axially therefrom, said depending skirt portion having cap locking means formed on the inner surface thereof and adapted to be engaged with and disengaged from complementary container locking means on a container; an outer cap having an end wall with a second skirt portion projecting axially from the periphery thereof, said second skirt portion loosely encompassing the first skirt portion to allow relative rotary movement between the inner and outer caps; to thereby allow the inner and outer caps to move between locking and unlocking positions; clutch means operatively associated with the inner surface of the outer cap and the outer surface of the inner cap and coupling the inner and outer caps in one position of axial displacement of said inner and outer caps and uncoupling the inner and outer caps in a second axial position of said inner and outer caps; ratchet lug means circularly disposed on one of said inner and outer caps and interposed said caps; a plurality of inclined detent members circularly disposed on one of said inner and outer caps and interposed said caps; said dome-shaped top panel providing a biasing force to maintain the inner and outer caps in said second axial position; said detent members drivingly engaging said ratchet lug means in said second axial position to drive the inner and outer caps as a unit in the tightening direction of the closure and slipping over said ratchet lug means in the untightening direction to prevent unscrewing of said inner cap; downward axial pressure on said outer cap overcoming the bias of said dome-shaped top panel by causing a portion of said outer cap to deform the dome-shaped panel to place the inner and outer caps in the first axial position; retaining means for loosely retaining said inner cap within said outer cap in a radial direction; and stop means for preventing deformation of said dome-shaped top panel in the locking position due to downward axial pressure on said inner cap and for allowing coupling of the inner and outer caps in the unlocking position to thereby allow the unscrewing of said inner cap.

20. The assembly as claimed in claim 1 wherein said stop means comprises at least one curved rib operatively associated with said clutch means.

21. A safety closure assembly comprising: an inner cap having a dome-shaped top panel with a skirt portion projecting axially therefrom, said depending skirt portion having cap locking means formed on the inner surface and adapted to be engaged with and disengaged from complementary container locking means on a container; an outer cap having an end wall with a second skirt portion projecting axially from the periphery thereof, said second skirt portion loosely encompassing the first skirt portion to allow relative rotary movement between the inner and outer caps; said end wall having an annular portion having a smaller thickness than the remainder of the end wall; clutch means operatively associated with the inner surface of the outer cap and the outer surface of the inner cap and coupling the inner and outer caps in one position of axial displacement of said inner and outer caps and uncoupling the inner and outer caps in a second axial position of said inner and outer caps; ratchet lug means circularly disposed on one of said inner and outer caps and interposed said caps; a plurality of spaced, inclined detent members circularly disposed on one of said inner and outer caps and interposed said caps; said dome-shaped top panel providing a biasing force to maintain the inner and outer caps in said second axial position; said detent members drivingly engaging said ratchet lug means in said second axial position to drive the inner and outer caps as a unit in the tightening direction of the closure and slipping over said ratchet lug means in the untightening direction to prevent unscrewing of said inner cap; downward axial pressure on said outer cap overcoming the bias of said dome-shaped top panel by causing a portion of said outer cap to deform the dome-shaped panel to place the inner and outer caps in the first axial position; and retaining means for loosely retaining said inner cap within said outer cap in a radial direction.

22. An outer cap member adapted to loosely retain an inner cap member of a safety closure therewithin to allow relative rotary movement therebetween, the outer cap member having an end wall with a skirt portion projecting axially therefrom; said end wall having an annular portion having a smaller thickness than the remainder of the end wall; clutch means disposed on the inner surface of the outer cap member adapted for coupling the inner and outer cap members in one position of axial displacement of the inner and outer cap members and uncoupling the inner and outer cap members in a second axial position of the inner and outer cap members; a plurality of spaced, inclined detent members circularly disposed on the inner surface of the outer cap member and adapted to drive a driven portion of the inner cap member in the second axial position to drive the inner and outer cap members as a unit in the tightening direction of the closure and adapted to slip over the driven portion of the inner cap member in the untightening direction to prevent unlocking of the inner cap member; wherein the annular portion allows the end wall to deform in the untightening direction to lessen the amount of friction between the detent members and the driven portion of the inner cap member.

* * * * *

UNITED STATES PATENT AND TRADEMARK OFFICE

CERTIFICATE OF CORRECTION

PATENT NO. : 4,319,690

DATED : March 16, 1982

INVENTOR(S) : Stewart H. Birrell et al

It is certified that error appears in the above-identified patent and that said Letters Patent is hereby corrected as shown below:

Column 1, line 64, "4,042,028" should read -- 4,032,028 --.

Column 5, line 17, "bed" should read -- bead --.

Signed and Sealed this

Twentieth Day of July 1982

[SEAL]

Attest:

GERALD J. MOSSINGHOFF

Attesting Officer

Commissioner of Patents and Trademarks